US011964322B2

(12) United States Patent
Conte et al.

(10) Patent No.: US 11,964,322 B2
(45) Date of Patent: Apr. 23, 2024

(54) SECONDARY COOLING APPARATUS IN A MACHINE FOR CONTINUOUS CASTING OF METAL PRODUCTS

(71) Applicant: Danieli & C. Officine Meccaniche S.p.A., Buttrio (IT)

(72) Inventors: Riccardo Conte, Ronchi Dei Legionari (IT); Andrea Carboni, Milan (IT); Gianfranco Marconi, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 17/924,239

(22) PCT Filed: May 12, 2021

(86) PCT No.: PCT/IT2021/050141
§ 371 (c)(1),
(2) Date: Nov. 9, 2022

(87) PCT Pub. No.: WO2021/229621
PCT Pub. Date: Nov. 18, 2021

(65) Prior Publication Data

US 2023/0191475 A1 Jun. 22, 2023

(30) Foreign Application Priority Data

May 13, 2020 (IT) ..... 102020000010909

(51) Int. Cl.
*B22D 11/124* (2006.01)
*B22D 11/22* (2006.01)

(52) U.S. Cl.
CPC ..... *B22D 11/1246* (2013.01); *B22D 11/225* (2013.01)

(58) Field of Classification Search
CPC ... B22D 11/124; B22D 11/1246; B22D 11/22; B22D 11/225
(Continued)

(56) References Cited

U.S. PATENT DOCUMENTS 4,424,855 A * 1/1984 Tsubakihara et al. ..... B22D 11/1246 164/455
4,699,202 A * 10/1987 Gilles ..... B22D 11/225 164/455
2019/0054520 A1 2/2019 Foshag et al.

FOREIGN PATENT DOCUMENTS

WO 2017/042059 A1 3/2017
WO 2018224304 A1 12/2018

OTHER PUBLICATIONS

1 International Search Report and Written Opinion dated Sep. 10, 2021 in PCT/IT2021/050141.

* cited by examiner

*Primary Examiner* — Kevin P Kerns
(74) *Attorney, Agent, or Firm* — Panitch Schwarze Belisario & Nadel LLP

(57) ABSTRACT

Secondary cooling apparatus in a machine for continuous casting of metal products, such that each metal product is cast, contained and guided along an axis of movement. The secondary cooling apparatus includes a plurality of cooling assemblies disposed in sequence one to the other along the continuous casting machine. Each assembly includes a plurality of cooling units each provided with one or more nozzles disposed along the axis of movement. The cooling units of each assembly are adjacent to each other to cover a width at least equal to the maximum width of the metal product which can be cast in the continuous casting machine.

10 Claims, 4 Drawing Sheets

(58) Field of Classification Search
USPC ..... 164/414, 455, 444, 486
See application file for complete search history.

SECONDARY COOLING APPARATUS IN A MACHINE FOR CONTINUOUS CASTING OF METAL PRODUCTS

CROSS-REFERENCE TO RELATED APPLICATIONS

This application is a Section 371 of International Application No PCT/IT2021/050141, filed May 12, 2021, which was published in the English language on Nov. 18, 2021, under International Publication No. WO 2021/229621 A1, which claims priority under 35 U.S.C. § 119(b) to Italian Application No. 102020000010909, filed May 13, 2020, the disclosures of each of which are incorporated herein by reference.

FIELD OF THE INVENTION

The present invention concerns a secondary cooling apparatus in a machine for continuous casting of metal products.

In particular, the secondary cooling apparatus acts on the metal products at the exit from the mold and along the roller path located downstream thereof. By way of example only, the cast metal products can be blooms, billets, slabs or other known types.

BACKGROUND OF THE INVENTION

It is known that a metal product, during the continuous casting, passes from a liquid state to a partly solid state, arriving at a completely solid state in a predetermined position downstream of the casting itself. During these steps the skin of the metal product, which contains a liquid metal core inside it, gradually thickens until it solidifies completely.

The controlled removal of heat from the cast metal product initially occurs by means of heat exchange with a primary cooling apparatus. The primary cooling apparatus comprises a plurality of cooling channels associated or integrated with the containing walls of the mold (crystallizer).

Downstream of the crystallizer there is then provided a secondary cooling apparatus which comprises a plurality of nozzles, interspersed with rollers for supporting and guiding the metal product, and a circuit for feeding one or more cooling fluids to the nozzles as above.

The heat exchange mechanisms that intervene in the secondary cooling apparatus are irradiation and convection.

Irradiation is a heat exchange mechanism that occurs between two surfaces at different temperatures, for example between the surface of the metal product and the surfaces of the rollers for supporting and guiding the latter.

Convection, which in these types of applications occurs in a forced manner, is determined by the delivery, on the metal product to be cooled, of one or more cooling fluids, possibly also a mixture thereof.

The nozzles are normally disposed between the support and guide rollers so as to direct the one or more cooling fluids directly onto the metal product. For this purpose, the nozzles can be disposed distanced from each other to cover, possibly overlapping, the entire transverse size of the cast metal product. Furthermore, the nozzles can deliver jets of cooling fluid that have different shapes, depending on the type of metal product to be cooled.

Conventionally, in continuous casting machines, the nozzles can be of the type that use only water, or of the type that use water and air.

In the case of nozzles that only deliver water, the latter is conveyed through a single orifice, or in cooperation with others, and sprayed onto the cast product. In order to adjust the cooling, in tins case, the water flow rate of the nozzle is varied so that a determinate convective heat exchange effect is achieved. Some examples of nozzles that only deliver water, and of the corresponding control methods, are described in patent documents WO 2017/042059 A1, WO 2018/224304A1 and US2019/0054520 A1.

In the case of nozzles that deliver water and air, the addition of air has the function of expanding the adjustment range of the nozzle, allowing to adjust the water flow rate within a wider range. One disadvantage of this type of nozzles is related to the high consumption of compressed air and the corresponding energy costs for its production, as well as the need for dedicated management components to control the air.

Typically, the nozzles are grouped into cooling units in order, for example, to define uniform cooling zones of the cast product, and at the same time simplify the configuration of the circuit for feeding the nozzles, which can become very complex also due to the number and the type of cooling fluids used.

The circuit for feeding the nozzles comprises means for pumping the cooling fluid(s), one or more assemblies for adjusting the flow comprising servo valves, flow meters, and pressure transducers, and a piping system, also known as "interconnecting piping", which fluidically connects the pumping means and the one or more adjustment assemblies to the cooling units.

The cooling units, normally disposed symmetrically with respect to the central axis of the metal product, can be grouped into rings, also called "loops", and controlled by respective flow adjustment assemblies, in order to define uniform cooling zones.

Typically, if "n" cooling zones are present inside the casting machine, the piping system has an equal number of pipes, which can double if the nozzles deliver water and air. Furthermore, a respective flow adjusting assembly is associated with each cooling zone.

Evidently, such a solution is very complex to achieve and also very bulky due to the extension of the piping system. Furthermore, it is also very difficult to manage and, given the high number of components, requires frequent maintenance interventions.

In other known solutions, the piping system comprises one pipe for delivering low pressure refrigerant fluid and another pipe for delivering high pressure refrigerant fluid. Both pipes feed the valve blocks positioned on board the cooling units and configured to allow the passage from low to high pressure and vice versa.

Although this solution allows to manage a large number of cooling zones using only two feed pipes, it does not allow to control the flow rate of fluid delivered by the individual nozzles, or by the individual cooling units.

There this therefore the need to perfect a secondary cooling apparatus in a machine for continuous casting of metal products that can overcome at least one of the disadvantages of the state of the art.

One purpose of the present invention is to provide a secondary cooling apparatus in a machine for continuous casting of metal products in which it is possible to achieve a variable delivery of the cooling water in a simple manner, and with equipment that is not bulky and is easy to manage.

Another purpose of the present invention is to provide a secondary cooling apparatus in which the piping system for feeding the cooling fluid has a limited extension.

Another purpose of the present invention is to provide a secondary cooling apparatus in which the flow adjusting assembly is simple and comprises a limited number of components.

Another purpose of the present invention is to provide a secondary cooling apparatus which requires limited maintenance interventions.

The Applicant has devised, tested and embodied the present invention to overcome the shortcomings of the state of the art and to obtain these and other purposes and advantages.

SUMMARY OF THE INVENTION

The present Invention is set forth and characterized in the independent claim. The dependent claims describe other characteristics of the present invention or variants to the main inventive idea.

In accordance with the above purposes, a secondary cooling apparatus in a machine for continuous casting of metal products, wherein each metal product is cast, contained and guided along an axis of movement, comprises a plurality of cooling assemblies disposed in sequence one to the other along the continuous casting machine.

Each of the assemblies as above comprises a plurality of cooing units each provided with one or more nozzles disposed along the axis of movement.

The cooling units of each assembly are disposed adjacent to each other to cover a width at least equal to the maximum width of the metal product which can be cast in the continuous casting machine.

According to one aspect of the present invention, each of the nozzles of each cooling unit comprises two or more orifices for delivering a refrigerant fluid onto the metal product to be cooled. Furthermore, one orifice of one nozzle is associated with a different fluid feed line from the other orifice of the same nozzle.

The homologous orifices of distinct nozzles of a same cooling unit are associated with the same feed line.

This solution allows to differentiate, and modulate, the flow rate of the cooling fluid in the various zones of the cast product, in particular on its width, simply by activating one and/or the other of the feed lines connected to homologous nozzles of different cooling units and of different cooling assemblies, so as to adapt the cooling action to the effective width of the cast product and to the punctual needs that arise. For example, it is possible to easily differentiate the intensity of the cooling in the central zone of the cast product with respect to its lateral zones.

Furthermore, this solution allows to use a reduced number of main conduits for feeding the fluid, which can be fed through a single valve assembly, for example a main servo valve, which sets a single feed flow rate, the variations of delivery flow rates of the cooling fluid onto the cast product then being managed by the selective opening/closing of homologous nozzles of the various cooling units/assemblies.

BRIEF DESCRIPTION OF THE DRAWINGS

These and other aspects, characteristics and advantages of the present invention will become apparent from the following description of some embodiments, given as a non-restrictive example with reference to the attached drawings wherein:

FIGS. 5*a*-5*d* show possible variants of the delivery orifices of FIG. 5;

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the various embodiments of the present invention, of which one or more examples are shown in the attached drawings. Each example is supplied by way of illustration of the invention and shall not be understood as a limitation thereof. For example, one or more characteristics shown or described insomuch as they are part of one embodiment can be varied or adopted on, or in association with, other embodiments to produce other embodiments. It is understood that the present invention shall include all such possible modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Figure 1:
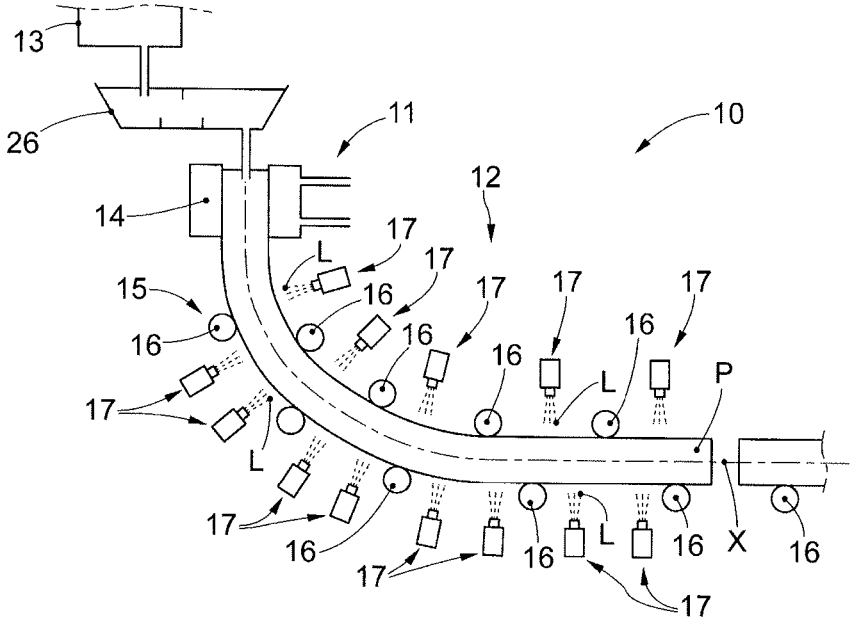
FIG. 1 schematically shows a continuous casting machine of metal products that comprises the secondary cooling apparatus in accordance with embodiments described here.

Embodiments described with reference to FIG. 1 concern a machine for the continuous casting of metal products, identified as a whole with reference number 10. The machine 10 is configured to continuously cast metal products P for example in the form of blooms, billets or slabs, or other forms known in the sector.

During the casting process, the metal products P are cooled first by means of a primary cooling apparatus 11, and then by means of a secondary cooling apparatus 12.

The machine 10 comprises a tundish 26, able to receive the liquid metal contained in a ladle 13, and a mold, or crystallizer, 14 which the liquid metal passes through.

The primary cooling apparatus 11 is directly associated with the crystallizer 14 while the secondary cooling apparatus 12 is disposed downstream of the crystallizer 14.

The secondary cooling apparatus 12 comprises a roller path 15 configured both to guide and contain the metal product P at exit from crystallizer 14 and also to remove the heat from the metal product P, for example by radiation and conduction.

The roller path 15 is able to support and move the cast metal product P along an axis of movement X which can be curved, straight or partly curved and partly straight.

The roller path 15 can comprise a plurality of rollers 16 which can be disposed suitably distanced from each other and with the axes of rotation parallel to each other and orthogonal to the axis of movement X. The rollers 16 are configured to guide the metal product P along the casting line up to the extraction zone.

For this purpose, the axes of rotation of the rollers 16 located above the metal product P can lie on a lying plane parallel and distanced with respect to the lying plane on which lie the axes of rotation of the rollers 16 located below the metal product P. In this way, the rollers 16 define a passage and drawing channel inside which the cast metal product is advanced.

In possible embodiments, the rollers 16 can also be disposed laterally to the product P, so as to also guide it along the sides.

The secondary cooling apparatus 12 comprises, in this specific case, a plurality of cooling assemblies G disposed in sequence with respect to each other along the continuous casting machine 10.

Figure 2:
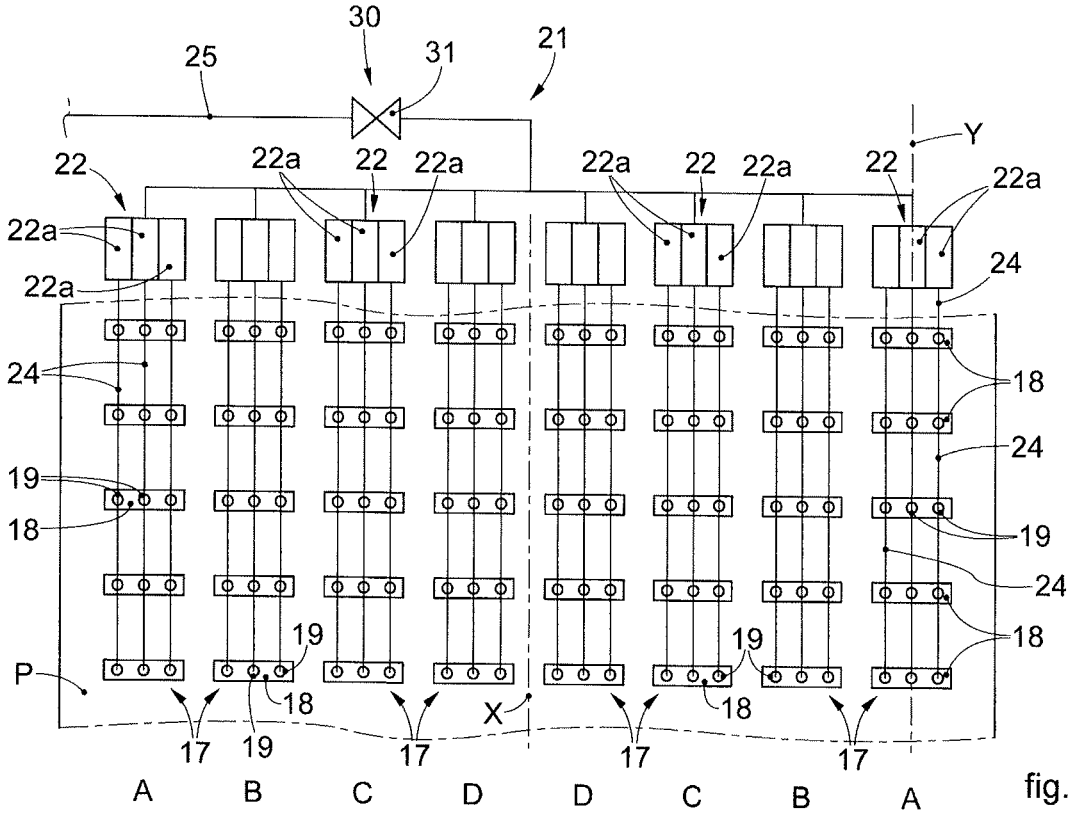
FIG. 2 schematically shows a cooling assembly provided with eight cooling units.
Figure 3:
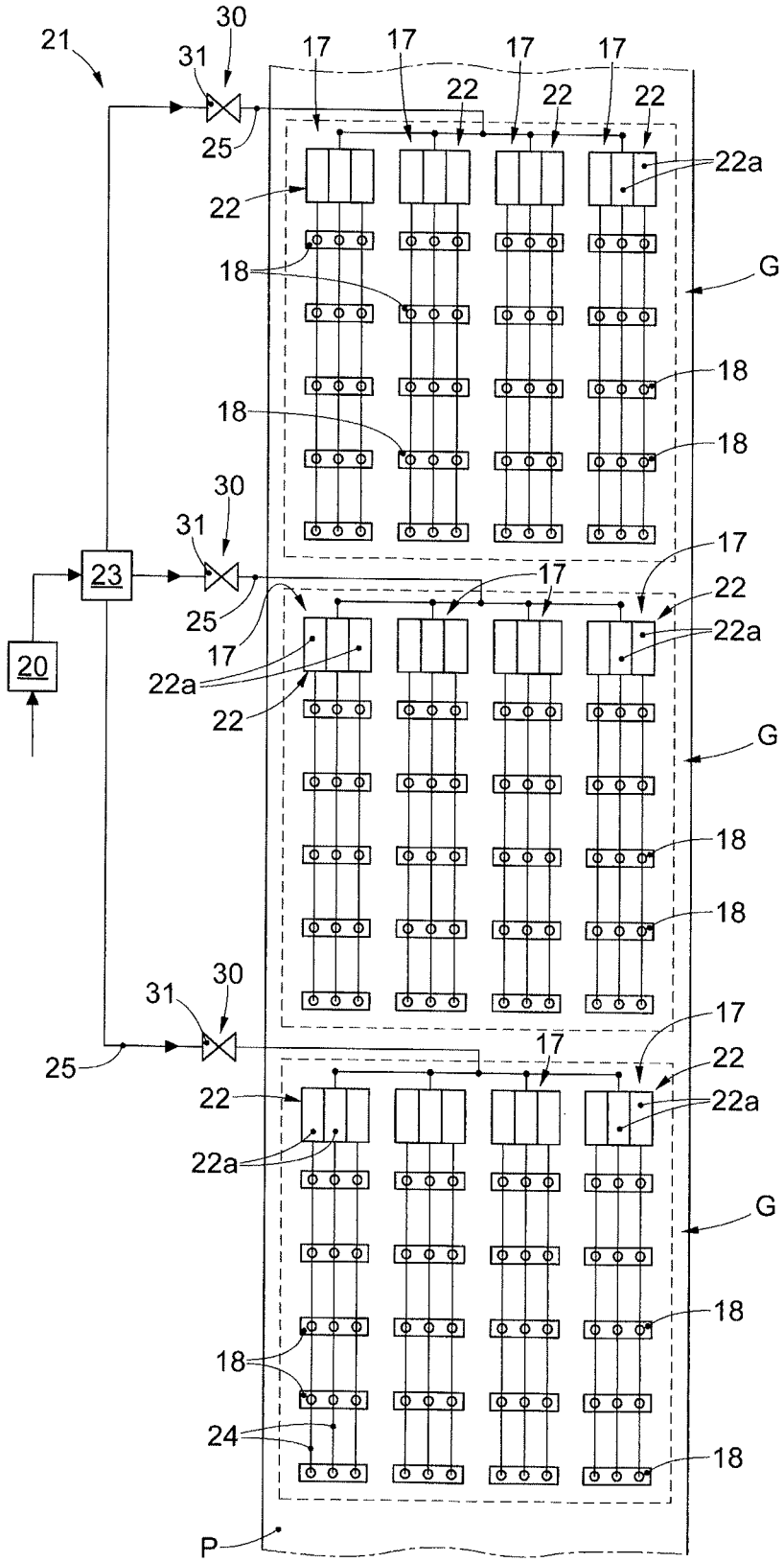
FIG. 3 schematically shows a possible configuration of the secondary cooling apparatus in accordance with embodiments described here.
Figure 4:
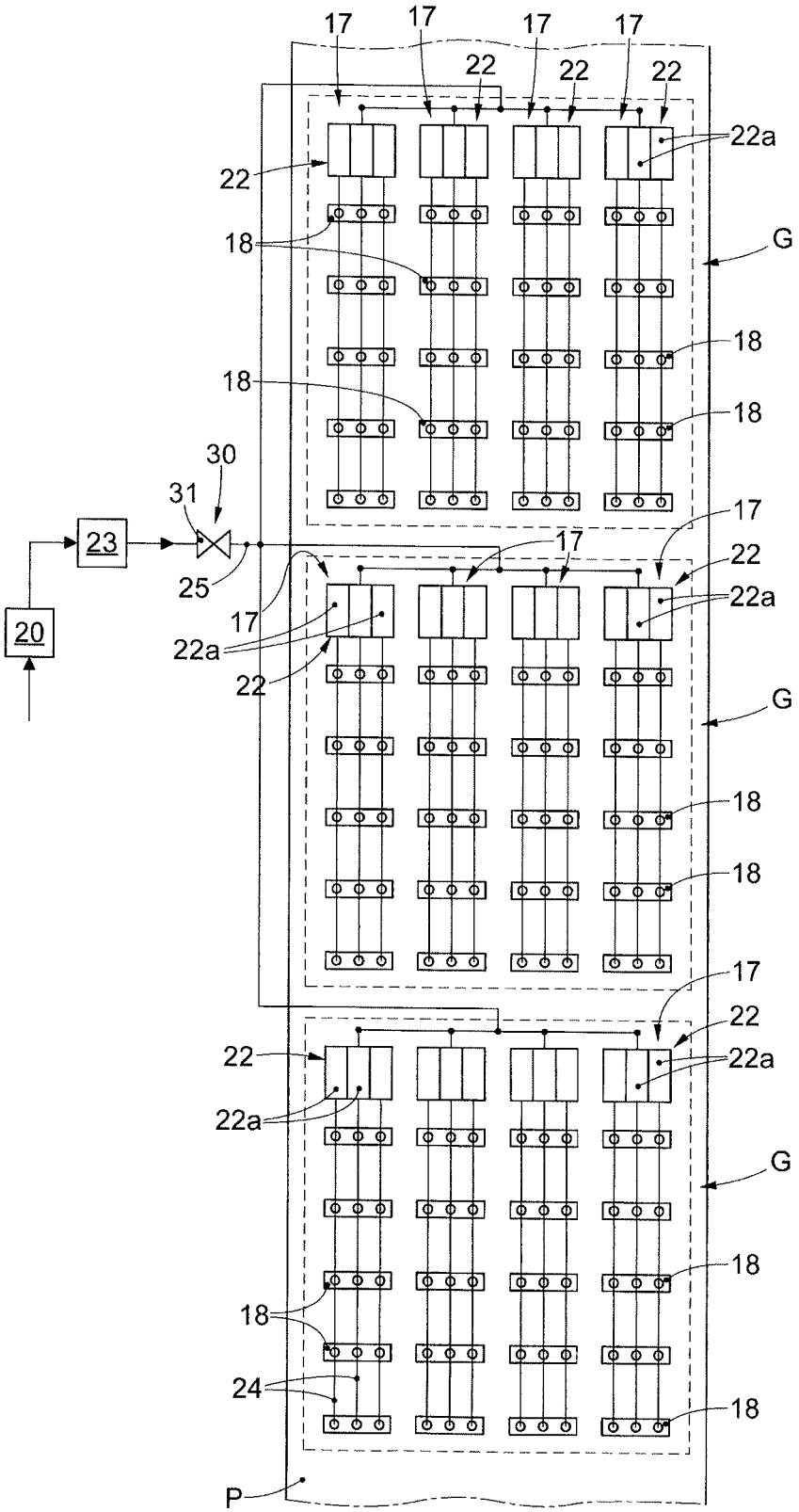
FIG. 4 schematically shows another possible configuration of the secondary cooling apparatus in accordance with embodiments described here.

With particular reference to FIGS. 2-4, each cooling assembly G can comprise a plurality of cooling units 17, each provided with one or more nozzles 18 disposed along the axis of movement X.

The cooling units 17 are adjacent to each other to cover a width at least equal to the maximum width of the metal product P that can be cast into the machine 10.

Each cooling unit 17 is able to deliver a determinate flow rate of at least one refrigerant fluid L onto a specific zone of the metal product P. The cooling units 17 can be associated with the roller path 15 cooperating with the latter to cool the metal product P in transit.

According to some embodiments, the cooling units 17 can be disposed both along the vertical segment and also along the curved segment, and possibly on the horizontal segment of the casting line and can act both on the bottom and also on the top of the metal product P. Optionally, the cooling units 17 can also act laterally with respect to the metal product P.

The cooling units 17 can determine the same cooling profile for the upper and lower surface of the metal product P according to the desired cooling curve, or they can determine different and independent cooling profiles.

According to some embodiments, each one of the nozzles 18 as above of each of the cooling units 17 comprises two or more orifices 19 for delivering the refrigerant fluid L onto the metal product P to be cooled, FIGS. 2-5.

Figure 5:
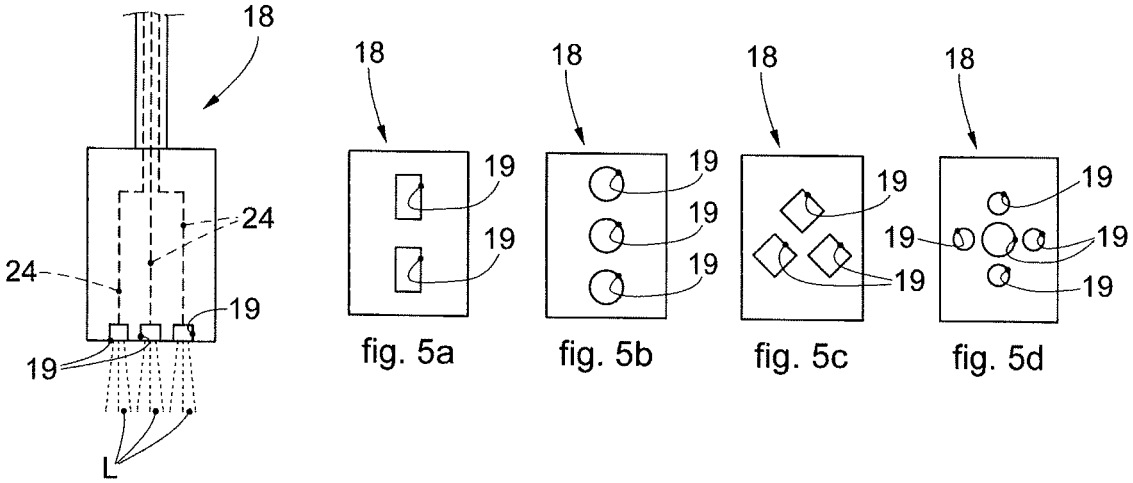
FIG. 5 schematically shows a nozzle in which the delivery orifices are visible.

In particular, it is provided that one orifice 19 of one nozzle 18 is associated with one feed line 24 distinct from the other orifice 19 of the same nozzle 18, FIG. 5. Furthermore, with particular reference to FIGS. 2-3, homologous orifices 19 of distinct nozzles 18 of a same cooling unit 17 are connected to the same feed line 24.

Furthermore, homologous orifices 19 of cooling units 17 of different assemblies G can be connected to the same feed line 24.

Here and hereafter in the description, with the term "homologous" referred to an orifice 19 we mean that one orifice 19 of one nozzle 18 corresponds according to geometric analogy, for example according to position, to one orifice 19 of another nozzle 18 of another cooling unit 17 and/or of a different cooling assembly U.

According to some embodiments, the nozzles 18 of each cooling unit 17, preferably in a number of two to seven, can be disposed along a longitudinal axis Y of development of the cooling unit 17, FIG. 2.

The nozzles 18 of a cooling unit 17 can be preferentially aligned along the longitudinal axis Y thereof, or they can be disposed alternately on one side and on the other with respect to the longitudinal axis Y defining a checkerboard configuration, or according to other possible configurations.

The cooling units 17 are disposed so that the nozzles 18 are, as a whole, distributed in a suitable manner both in the direction of the axis of movement X and also in directions transverse to the axis of movement X so as to guarantee the cooling of any zone whatsoever of the metal product P.

According to some embodiments, the orifices 19 of a same nozzle 18 are fed independently of each other, by opening or closing one or more feed lines 24 associated with the nozzle 18. The feed lines 24 can be configured as pipes, of variable length and with any section whatsoever, each of which communicates, directly or by means of a further branch, with an orifice 19 of the nozzle 18. The feed lines 24 can also have a structural function supporting the nozzles 18.

The orifices 19 of a same nozzle 18 can have the same area of the outlet section, FIGS. 5*a*-5*c*, or have different areas of the outlet section, 5*d*. The shape of the outlet section of each orifice 19 determines the shape of the jet of refrigerant fluid L which can be, for example, blade-shaped or cone-shaped, or other shapes deemed suitable to cool the metal product P.

With reference to FIGS. 2-4, the secondary cooling apparatus 12 also comprises a feed circuit 21 for feeding the cooling units 17. The feed circuit 21 comprises a plurality of valve assemblies 22, wherein each valve assembly 22 is associated with a respective cooling unit 17. Each valve assembly 22 comprises at least one valve 22*a* for each of the homologous orifices 19 of different nozzles 18 of a same cooling unit 17.

The feed circuit 21 is connected to at least one main feed conduit 25 configured to fluidically connect means 23 for pumping the refrigerant fluid L to the valve assemblies 22. In particular, each main feed conduit 25 comprises a single flow interception mean 30 configured to control, and possibly adjust, the flow rate of refrigerant fluid L passing in the at least one main feed conduit 25 toward the cooling units 17.

Here and hereafter in the description, by "main feed conduit 25" we mean one or more pipes connected on one side to the pumping means 23, and on the other to the valve assemblies 22, which then connect to the individual feed lines 24.

Each valve 22*a* is connected, by means of a respective feed line 24, to homologous orifices 19 of the nozzles 18 of the respective cooling unit 17, and possibly to different cooling units 17 also of different cooling assemblies G.

According to some embodiments, in order to reduce the length of the feed lines 24 to a minimum, the valve assembly 22 can be attached directly to the appropriate cooling unit 17, for example in a head position.

Each valve 22*a* can be of the On/Off type, to allow or obstruct the passage of the refrigerant fluid L toward the orifices 19.

According to some embodiments, the valve assemblies 22 can advantageously be actuated hydraulically or electrically, so as to keep the electrical components in a safe zone, far from possible interactions with the refrigerant fluid L.

In one possible configuration, in which the orifices 19 of the nozzle 18 all have different outlet sections, each cooling unit 17 has the possibility of actuating $2^n$ possible cooling modes, where the number "2" indicates the two functioning possibilities (On/Off), "n" is the number of orifices 19 that each nozzle 18 consists of. If, on the other hand, the orifices 19 all have the same outlet section, the possible cooling modes are n+1. Possible intermediate configurations are included in these values.

The cooling units 17 of a determinate cooling assembly G can be activated independently of each other, since each of them is commanded by a respective valve assembly 22.

According to some embodiments, the cooling units 17 of a determinate cooling assembly G can advantageously be activated symmetrically with respect to a central axis of symmetry of the metal product P so as to define symmetrical and independent cooling zones.

In the schematic example shown in FIG. 2, four cooling zones A, B, C, D are defined, symmetrical with respect to the central axis of symmetry of the metal product P, which in this case corresponds to the axis of movement X. Considering that there is a single flow interception mean 30 to control the flow rate, all the nozzles 18 work with the same pressure but, by selectively activating a certain number of orifices 19, it is possible to obtain different flow rates on the width and/or length of the metal product P in transit, and therefore zones with different cooling efficiency. For example, it will be possible to achieve the following configuration:

- zones A completely closed (the metal product P is narrower than the wet zone),
- zones B with low cooling flow rate (edges), opening only a first 19*a* and/or a second orifice 19*b* of each nozzle 18 present in zone B,
- zones C and D with high cooling flow rate, since they are located in the center of the metal product P; in these zones, all three orifices 19*a*, 19*b*, 19*c* are open.

Figure 6:
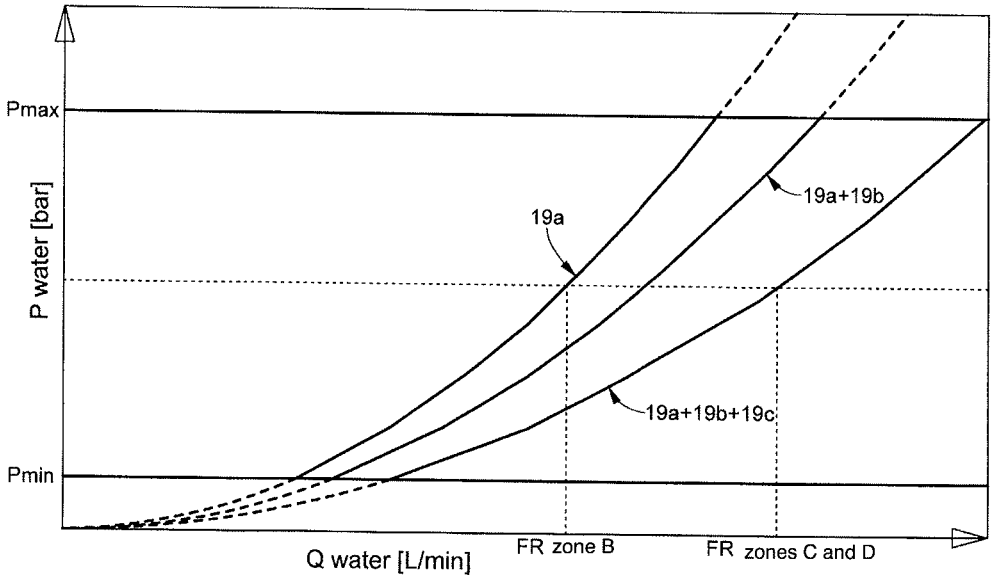
FIG. 6 is a flow rate-pressure graph which shows the functioning modes of the cooling assembly of FIG. 2 provided, by way of example, with nozzles as in FIG. 5*b* or FIG. 5*c*.

The graph shown in FIG. 6 shows the pressure/flow rate relation for the nozzle 18, for example in FIG. 5*b* or FIG. 5*c*. The three curves refer to the configurations of one, two or three functioning orifices 19. In this example, two cooling zones have been identified (FR zone B and FR zones C and D), but in theory it is possible to define as many cooling zones as there are cooling units 17 in that cooling assembly G.

According to some embodiments, each cooling assembly G is fed in an autonomous manner by means of its own main feed conduit 25 which connects the pumping means 23 to the cooling assembly G, FIG. 3.

According to other embodiments, two or more of the cooling assemblies G are fed by a same main feed conduit 25 which connects the pumping means 23 to the cooling assemblies G through the respective feed lines 24, FIG. 4. This configuration allows to reduce the number of main feed conduits 25 to a minimum and therefore allows to simplify the construction of the secondary cooling apparatus 12.

According to some embodiments, the flow interception mean 30 of each main feed conduit 25 can be for example a servo valve 31. Furthermore, it is also possible to provide the presence of flow meters and pressure transducers.

The presence of a single servo valve 31 for controlling the flow rate of refrigerant fluid L passing in a main feed conduit 25 allows all the nozzles 18 of the cooling units 17 of that specific cooling assembly G to deliver the refrigerant fluid L at the same pressure. However, by selectively activating a certain number of orifices 19 by opening the valves 22*a*, it is possible to partialize the delivery of a same nozzle 18 and therefore obtain different flow rates with different cooling efficiency, as described above.

According to some embodiments, the secondary cooling apparatus 12 can comprise a control and command unit 20 in which a mathematical model is implemented, configured to estimate the surface temperature of the metal product P in a punctual manner. The flow rates of refrigerant fluid L are modified so that the temperature estimated by the mathematical model corresponds to the desired one.

The secondary cooling apparatus 12 can comprise surface temperature detectors able to allow a verification of the punctual temperature on the metal product P.

According to possible embodiments, the surface temperature detectors can allow a feedback control of the flow rate of the refrigerant fluid L. In this case, the surface temperature detectors can detect the temperature of a specific zone of the metal product P and send a respective operating signal to the control and command unit 20 so as to carry out a feedback control in order to define the flow rate values of refrigerant fluid L that the cooling units 17 have to deliver.

The control and command unit 20 can be configured to receive one or more process operating parameters. The process operating parameters can be chosen in a group comprising the volumetric flow rate of the metal product P, the temperature detected on the metal product P zone by zone, the chemical composition of the metal product P (or steel grade), the format of the product, or other process parameters considered as characteristic.

The control and command unit 20 is also configured to process and send an operating command signal to the means 23 for pumping the refrigerant fluid L and also to the flow interception means 30 and to the valves 22*a* of the valve assemblies 22 so that the desired cooling profiles are achieved.

According to some embodiments, the refrigerant fluid L can be water, possibly treated. However, the use of a refrigerant mixture comprising at least a first liquid refrigerant fluid, for example water, and at least a second aeriform refrigerant fluid, for example air, is not excluded. It is entirely evident that the use of the refrigerant fluid, or mixture, can determine modifications to the systems that regulate the pumping of these fluids.

It is clear that modifications and/or additions of part may be made to the secondary cooling apparatus in a machine for continuous casting of metal products as described heretofore, without departing from the field and scope of the present invention.

It is also clear that, although the present invention has been described with reference to some specific examples, a person of skill in the art shall certainly be able to achieve many other equivalent forms of a secondary cooling apparatus in a machine for continuous casting of metal products, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims

The invention claimed is:

1. A secondary cooling apparatus (12) in a machine (10) for continuous casting of metal products (P), wherein each metal product (P) is cast, contained, and guided along an axis of movement (X), said secondary cooling apparatus (12) comprising:

- a plurality of cooling assemblies (G) disposed in sequence along said continuous casting machine (10),
- wherein each of said assemblies (G) comprises a plurality of cooling units (17) each provided with one or more nozzles (18) disposed along the axis of movement (X), wherein said cooling units (17) of each assembly (G) are adjacent to each other to cover a width at least equal to a maximum width of the metal product (P) which is cast in the continuous casting machine (10), wherein each of said nozzles (18) of each of the cooling units (17) comprises two or more orifices (19) for delivering a refrigerant fluid (L) onto the metal product (P) to be cooled, one orifice (19) of a nozzle (18) being associated with a feed line (24) for feeding the refrigerant fluid distinct from another of the two or more orifices of the same nozzle (18), homologous orifices (19) of distinct nozzles (18) of a same cooling unit (17) being associated with the same feed line (24), wherein, said secondary cooling apparatus (12) also comprises a feed circuit (21) for feeding said cooling units (17) and has a plurality of valve assemblies (22), wherein each valve assembly (22) is associated with a respective one of said cooling unit (17), said feed circuit (21) being connected to at least one main feed conduit (25) configured to fluidically connect pumping means (23) to said valve assemblies (22), wherein said at least one main feed conduit (25) comprises a single flow interception means (30) configured to control a flow rate of refrigerant fluid (L) passing in said at least one main feed conduit (25) toward said cooling units (17).

2. The secondary cooling apparatus as in claim 1, wherein homologous orifices (19) of distinct nozzles (18) of distinct cooling units (17) and of distinct cooling assemblies (G) are associated with the same feed line (24).

3. The secondary cooling apparatus as in claim 1, wherein each valve assembly (22) comprises at least one valve (22*a*) for each of said homologous orifices (19) of distinct nozzles of a same cooling unit (17).

4. The apparatus as in claim 3, wherein each valve (22*a*) is of the On/Off type.

5. The apparatus as in claim 1, wherein each cooling assembly (G) is fed autonomously by means of its own conduit (25) which connects said pumping means (23) to said cooling assembly (G).

6. The apparatus as in claim 1, wherein two or more of said cooling assemblies (G) are fed by the same main feed conduit (25) which connects said pumping means (23) to said cooling assemblies (G).

7. The apparatus as in claim 1, wherein said flow interception means (30) comprises a servo valve (31) configured to guarantee a flow of refrigerant fluid (L) at a same pressure toward the cooling units (17) connected to the main feed conduit (25) which is associated with said servo valve (31).

8. The apparatus as in claim 1, wherein each nozzle (18) is activated according to a number of cooling modes comprised between n+1 and $2^n$, where n is the number of orifices (19) of said nozzle (18).

9. The apparatus as in claim 1, wherein the cooling units (17) of a determinate cooling assembly (G) are activated independently of each other.

10. The apparatus as in claim 1, wherein the cooling units (17) of a determinate cooling assembly (G) are activated symmetrically with respect to a central axis of symmetry of said metal product (P) in order to define symmetrical and independent cooling zones.

* * * * *